US010038249B2

(12) United States Patent
Lo et al.

(10) Patent No.: US 10,038,249 B2
(45) Date of Patent: Jul. 31, 2018

(54) MOBILE DEVICE

(71) Applicant: Quanta Computer Inc., Taoyuan (TW)

(72) Inventors: Wen-Yuan Lo, Taoyuan (TW); Jui-Chun Jao, Taoyuan (TW); Lieh-Hung Liao, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 79 days.

(21) Appl. No.: 14/986,009

(22) Filed: Dec. 31, 2015

(65) Prior Publication Data

US 2017/0155198 A1 Jun. 1, 2017

(30) Foreign Application Priority Data

Dec. 1, 2015 (TW) ..... 104140048 A

(51) Int. Cl.
*H01Q 13/10* (2006.01)
*H01Q 1/24* (2006.01)

(52) U.S. Cl.
CPC ..... *H01Q 13/10* (2013.01); *H01Q 1/243* (2013.01)

(58) Field of Classification Search
CPC ..... H01Q 13/10; H01Q 1/243
USPC ..... 343/745, 836
See application file for complete search history.

(56) References Cited

U.S. PATENT DOCUMENTS 8,054,231 B2 * 11/2011 Ahn ..... H01Q 13/106 343/702
8,711,044 B2 * 4/2014 Arkko ..... H04M 1/026 343/702
9,455,498 B2 * 9/2016 Yosui ..... H01Q 7/00
9,576,238 B2 * 2/2017 Yosui ..... G06K 19/07783
2001/0053677 A1 * 12/2001 Schiffer ..... H01Q 1/22 455/128
2009/0153410 A1 6/2009 Chiang et al.
2011/0031320 A1 * 2/2011 Kato ..... G06K 19/07749 235/492
2011/0227799 A1 * 9/2011 Hashimoto ..... H01Q 1/2225 343/702
2016/0190709 A1 * 6/2016 Niu ..... H01Q 21/28 343/725
2017/0033435 A1 * 2/2017 Nakano ..... H01Q 1/24

OTHER PUBLICATIONS

Chinese language office action dated Jan. 10, 2017, issued in application No. TW 104140048.

* cited by examiner

*Primary Examiner* — Dameon E Levi
*Assistant Examiner* — Jennifer F Hu
(74) *Attorney, Agent, or Firm* — McClure, Qualey & Rodack, LLP

(57) ABSTRACT

A mobile device includes a metal back cover and a printed circuit board. The metal back cover has a slot. The printed circuit board includes a dielectric substrate, a first metal element, a second metal element, and via elements. The first metal element is disposed on a top surface of the dielectric substrate. The second metal element is disposed on a bottom surface of the dielectric substrate. The via elements are formed in the dielectric substrate, and are coupled between the first metal element and the second metal element. The first metal element is coupled to the metal back cover, such that a slot antenna is formed by the printed circuit board and the slot of the metal back cover. The slot antenna is excited by a signal source which is coupled to the second metal element.

9 Claims, 5 Drawing Sheets

MOBILE DEVICE

CROSS REFERENCE TO RELATED APPLICATIONS

This application claims priority of Taiwan Patent Application No. 104140048 filed on Dec. 1, 2015, the entirety of which is incorporated by reference herein.

BACKGROUND OF THE INVENTION

Field of the Invention

The disclosure generally relates to a mobile device, and more specifically, to a mobile device with a slot antenna.

Description of the Related Art

With the progress of mobile communication technology, mobile devices like portable computers, mobile phones, tablet computers, multimedia players, and other hybrid functional portable electronic devices have become more common. To satisfy the demand from users, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

In order to improve the appearance, designers often incorporate metal elements into mobile devices. However, the added metal elements tend to negatively affect the antennas for wireless communication in mobile devices, thereby degrading the total communication quality of mobile devices. As a result, there is a need to propose a mobile device with a novel antenna structure, so as to overcome the problems of the prior art.

BRIEF SUMMARY OF THE INVENTION

In a preferred embodiment, the invention is directed to a mobile device including a metal back cover and a first PCB (Printed Circuit Board). The metal back cover has a first slot. The first PCB includes a first dielectric substrate, a first metal element, a second metal element, and a plurality of first via elements. The first metal element is disposed on a top surface of the first dielectric substrate. The second metal element is disposed on a bottom surface of the first dielectric substrate. The first via elements are formed in the first dielectric substrate and coupled between the first metal element and the second metal element. The first metal element is coupled to the metal back cover, such that a first slot antenna is formed by the first PCB and the first slot of the metal back cover. The first slot antenna is excited by a first signal source. The first signal source is coupled to the second metal element.

In some embodiments, the first metal element has a closed loop structure and surrounds a first nonconductive region, and the first nonconductive region is aligned with the first slot of the metal back cover.

In some embodiments, the first slot of the metal back cover has a first vertical projection on the first PCB, and the whole first vertical projection is inside the first nonconductive region.

In some embodiments, the first metal element is affixed by conductive paste to a periphery of the first slot of the metal back cover.

In some embodiments, the second metal element includes a first portion and a second portion. The first portion and the second portion are separate from each other and are both coupled through the first via elements to the first metal element. A positive electrode of the first signal source is coupled to the first portion, and a negative electrode of the first signal source is coupled to the second portion.

In some embodiments, the metal back cover further has a second slot, and the mobile device further includes a second PCB. The second PCB includes a second dielectric substrate, a third metal element, a fourth metal element, and a plurality of second via elements. The third metal element is disposed on a top surface of the second dielectric substrate. The fourth metal element is disposed on a bottom surface of the second dielectric substrate. The second via elements are formed in the second dielectric substrate and coupled between the third metal element and the fourth metal element. The third metal element is coupled to the metal back cover, such that a second slot antenna is formed by the second PCB and the second slot of the metal back cover. The second slot antenna is excited by a second signal source. The second signal source is coupled to the fourth metal element.

In some embodiments, the third metal element has a closed loop structure and surrounds a second nonconductive region, and the second nonconductive region is aligned with the second slot of the metal back cover.

In some embodiments, the second slot of the metal back cover has a second vertical projection on the second PCB, and the whole second vertical projection is inside the second nonconductive region.

In some embodiments, the fourth metal element includes a third portion and a fourth portion. The third portion and the fourth portion are separate from each other and are both coupled through the second via elements to the third metal element. A positive electrode of the second signal source is coupled to the third portion, and a negative electrode of the second signal source is coupled to the fourth portion.

In some embodiments, the first slot antenna and the second slot antenna operate in the same operation frequency band from about 2400 MHz to about 2500 MHz and further from about 5150 MHz to about 5850 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1A:
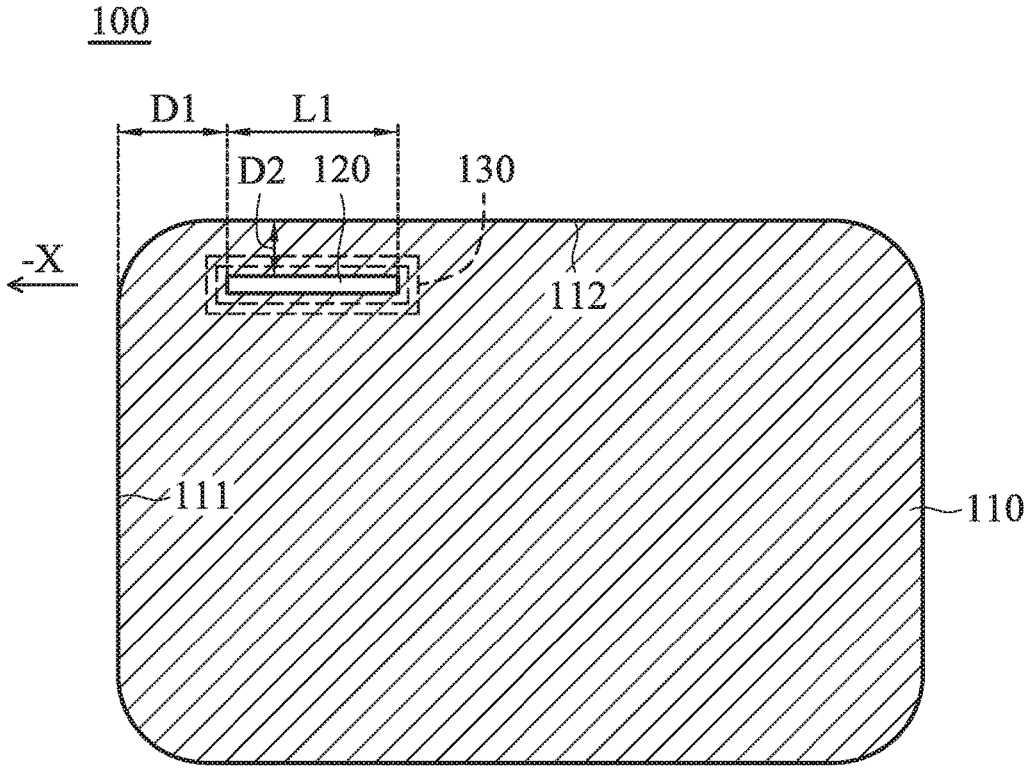
FIG. 1A is a top view of a mobile device according to an embodiment of the invention.
Figure 1B:
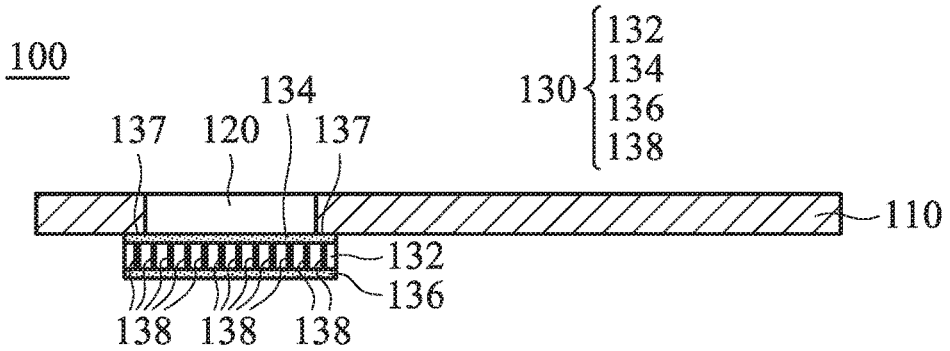
FIG. 1B is a cross-sectional view of a mobile device according to an embodiment of the invention.

FIG. 1A is a top view of a mobile device 100 according to an embodiment of the invention. FIG. 1B is a cross-sectional view of the mobile device 100 according to an embodiment of the invention. The mobile device 100 may be a smartphone, a tablet computer, or a notebook computer. As shown in FIG. 1A and FIG. 1B, the mobile device 100 at least includes a metal back cover 110 and a first PCB (Printed Circuit Board) 130. It should be understood that the mobile device 100 may further include other components, such as a processor, a battery module, a display device, a keyboard, and a transceiver, although they are not displayed in FIG. 1A and FIG. 1B. In some embodiments, if the mobile device 100 is a notebook computer, the metal back cover 110 may be disposed on an upper cover of the notebook computer, so as to improve the appearance of the whole computer device. The metal back cover 110 has at least a first slot 120. For example, the first slot 120 may have a long and narrow rectangular shape. The first slot 120 of the metal back cover 110 may be filled with a nonconductive material, such as a plastic material. The first PCB 130 includes a first dielectric substrate 132, a first metal element 134, a second metal element 136, and a plurality of first via elements 138. The first metal element 134 is a metal plane disposed on a top surface of the first dielectric substrate 132. The second metal element 136 is another metal plane disposed on a bottom surface of the first dielectric substrate 132. The first via elements 138 are formed in the first dielectric substrate 132 and coupled between the first metal element 134 and the second metal element 136. The first metal element 134 is coupled to the metal back cover 110. For example, the first metal element 134 may be affixed by conductive paste 137 to a periphery of the first slot 120 of the metal back cover 110. A first slot antenna is formed by the first PCB 130 and the first slot 120 of the metal back cover 110. The first slot antenna is excited by a first signal source 190 which is coupled to the second metal element 136.

Figure 2A:
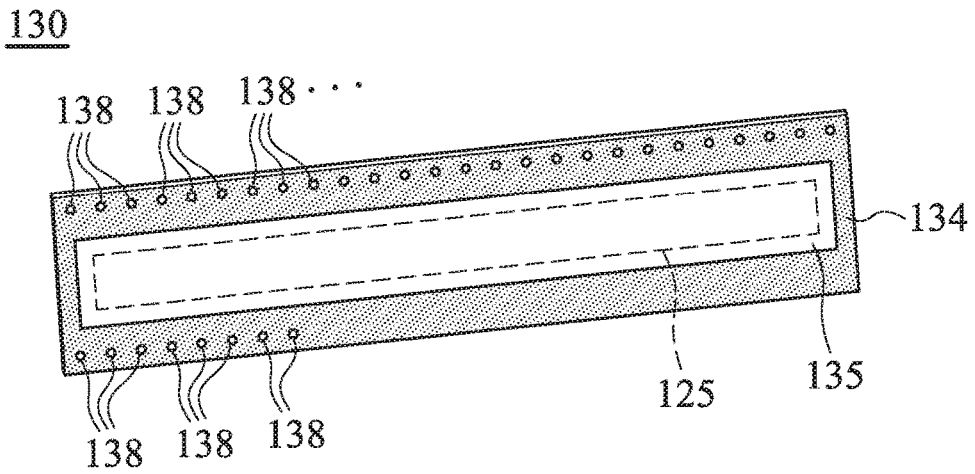
FIG. 2A is a top view of a first PCB (Printed Circuit Board) according to an embodiment of the invention.
Figure 2B:
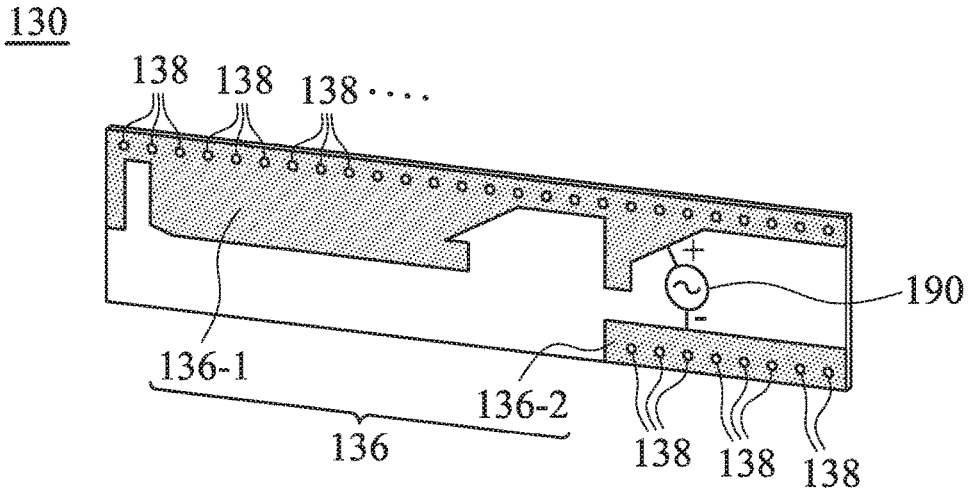
FIG. 2B is a bottom view of a first PCB according to an embodiment of the invention.

FIG. 2A is a top view of the first PCB 130 according to an embodiment of the invention. FIG. 2B is a bottom view of the first PCB 130 according to an embodiment of the invention. As shown in FIG. 2A, on the top surface of the first PCB 130, the first metal element 134 has a closed loop structure and surrounds a first nonconductive region 135. For example, the first metal element 134 may have a hollow rectangular shape, and its inner hollow portion is the first nonconductive region 135. The first nonconductive region 135 is aligned with the first slot 120 of the metal back cover 110. Specifically, the first slot 120 of the metal back cover 110 has a first vertical projection 125 on the first PCB 130, and the whole first vertical projection 125 is inside the first nonconductive region 135. That is, the area of the first slot 120 of the metal back cover 110 is smaller than or equal to the area of the first nonconductive region 135. As shown in FIG. 2B, on the bottom surface of the first PCB 130, the second metal element 136 includes a first portion 136-1 and a second portion 136-2. The first portion 136-1 and the second portion 136-2 are separate from each other and are both coupled through the first via elements 138 to the first metal element 134. The first portion 136-1 may have a relatively long irregular shape, and the second portion 136-2 may have a relatively short straight-line shape. A positive electrode of the first signal source 190 is coupled to the first portion 136-1, and a negative electrode of the first signal source 190 is coupled to the second portion 136-2.

The invention forms a unique first slot antenna on the metal back cover 110, and the first slot antenna uses periphery metal portions around the first slot 120 of the metal back cover 110 as a main radiator. With such a design, the metal back cover 110 is considered as a part of the antenna element. The metal back cover 110 does not interfere with the radiation pattern of the antenna element, and conversely, it can increase the radiation efficiency of the antenna element. The invention can enhance the side radiation of the mobile device 100. For example, according to practical measurements, the first slot antenna has a relatively strong radiation strength in the direction along −X axis of FIG. 1A, but a conventional slot antenna does not. In addition, the first slot antenna of the invention is directly excited by the first PCB 130 which is coupled to the first signal source 190, and the proposed design is different from a convention slot antenna which is excited by mutual coupling. The first PCB 130 has two metal plates and is affixed to the metal back cover 110, and such a design has the advantages of reducing the area of antenna ground copper, decreasing manufacturing time, suppressing manufacturing errors, and reducing manufacturing cost. Accordingly, the invention is suitable for application in a variety of small-size mobile devices.

The element sizes of the mobile device 100 may be as follows. The length L1 of the first slot 120 of the metal back cover 110 may be equal to 0.5 wavelength ($\lambda/2$) of a central operation frequency of the first slot antenna, or may be 60 mm. The spacing D1 between the first slot 120 of the metal back cover 110 and a first edge 111 of the metal back cover 110 may be from 40 mm to 50 mm. The spacing D2 between the first slot 120 of the metal back cover 110 and a second edge 112 of the metal back cover 110 may be longer than 10 mm. The second edge 112 of the metal back cover 110 may be adjacent to a hinge of the mobile device 100. The above sizes can enhance the side radiation of the mobile device 100.

In some embodiments, the first signal source 190 is coupled through a first coaxial cable to the second metal element 136, so as to excite the first slot antenna. The length of the first coaxial cable may be correlated to the size of a display device of the mobile device 100. For example, if the size of the display device of the mobile device 100 is 17-inch, the length of the first coaxial cable should be shorter than 500 mm; if the size of the display device of the mobile device 100 is 15-inch, the length of the first coaxial cable should be shorter than 550 mm; and if the size of the display device of the mobile device 100 is 13-inch, the length of the first coaxial cable should be shorter than 600 mm. In other words, if the display device becomes larger, the upper limit of the length of the first coaxial cable will become lower, and conversely, if the display device becomes smaller, the upper limit of the length of the first coaxial cable will become higher. The above design helps to suppress transmission line loss and maintain good radiation efficiency of the first slot antenna.

Figure 3A:
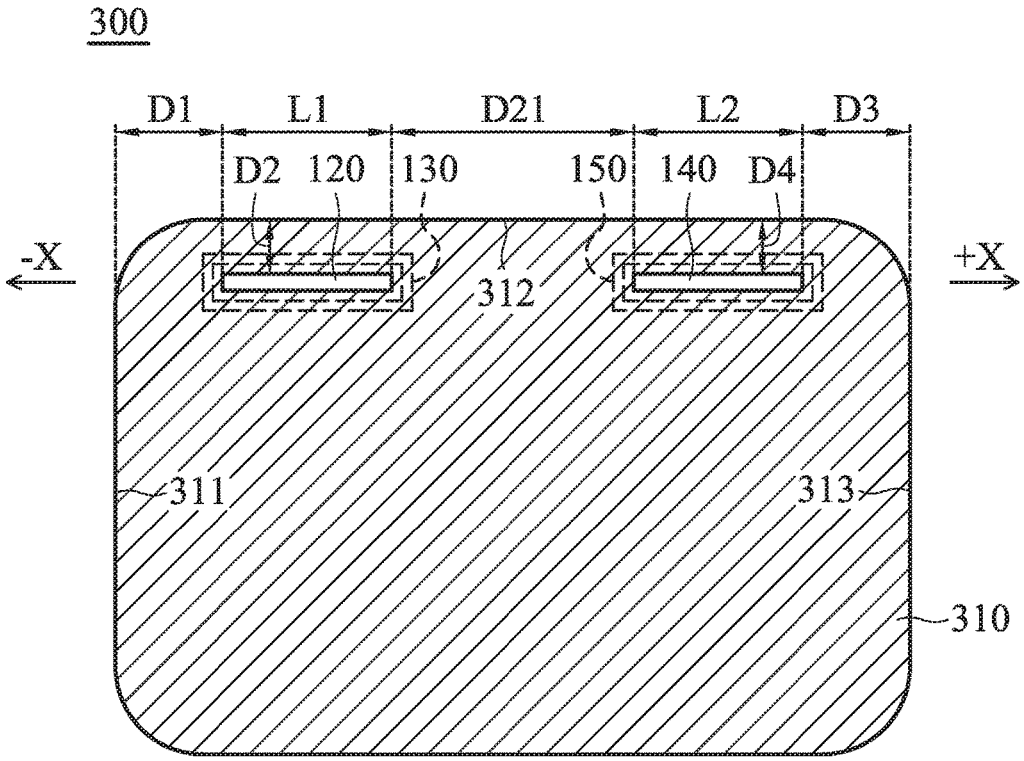
FIG. 3A is a top view of a mobile device according to an embodiment of the invention.
Figure 3B:
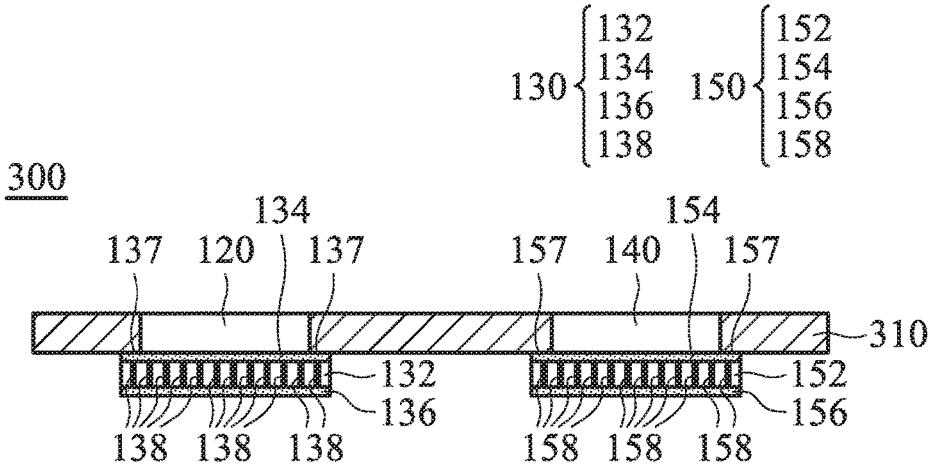
FIG. 3B is a cross-sectional view of a mobile device according to an embodiment of the invention.

FIG. 3A is a top view of a mobile device 300 according to an embodiment of the invention. FIG. 3B is a cross-sectional view of the mobile device 300 according to an embodiment of the invention. FIG. 3A and FIG. 3B are similar to FIG. 1A and FIG. 1B. In the embodiment of FIG. 3A and FIG. 3B, a metal back cover 310 of the mobile device 300 further has a second slot 140, and the mobile device 300 further includes a second PCB 150. For example, the second slot 140 may have a long and narrow rectangular shape. The second slot 140 of the metal back cover 310 may be filled with a nonconductive material. The second PCB 150 includes a second dielectric substrate 152, a third metal element 154, a fourth metal element 156, and a plurality of second via elements 158. The third metal element 154 is a metal plane disposed on a top surface of the second dielectric substrate 152. The fourth metal element 156 is another metal plane disposed on a bottom surface of the second dielectric substrate 152. The second via elements 158 are formed in the second dielectric substrate 152 and coupled between the third metal element 154 and the fourth metal element 156. The third metal element 154 is coupled to the metal back cover 310. For example, the third metal element 154 may be affixed by conductive paste 157 to a periphery of the second slot 140 of the metal back cover 310. A second slot antenna is formed by the second PCB 150 and the second slot 140 of the metal back cover 310. The second slot antenna is excited by a second signal source 290 which is coupled to the fourth metal element 156.

Figure 4A:
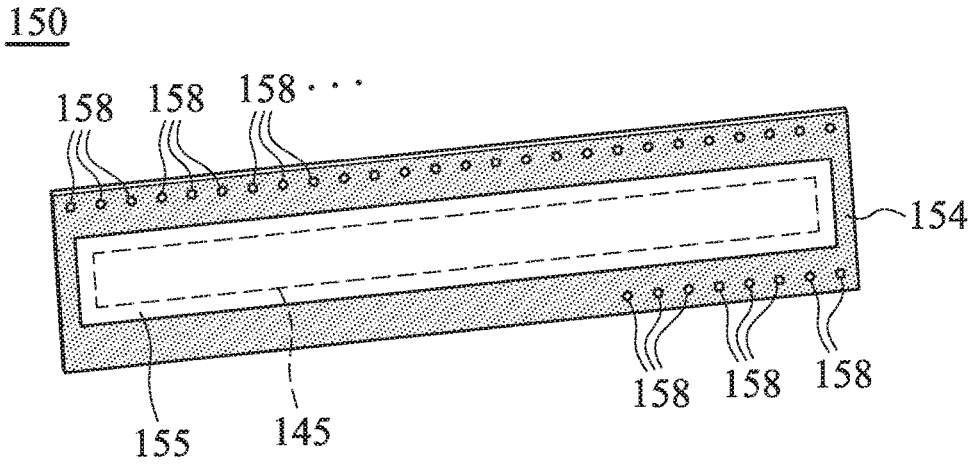
FIG. 4A is a top view of a second PCB according to an embodiment of the invention.
Figure 4B:
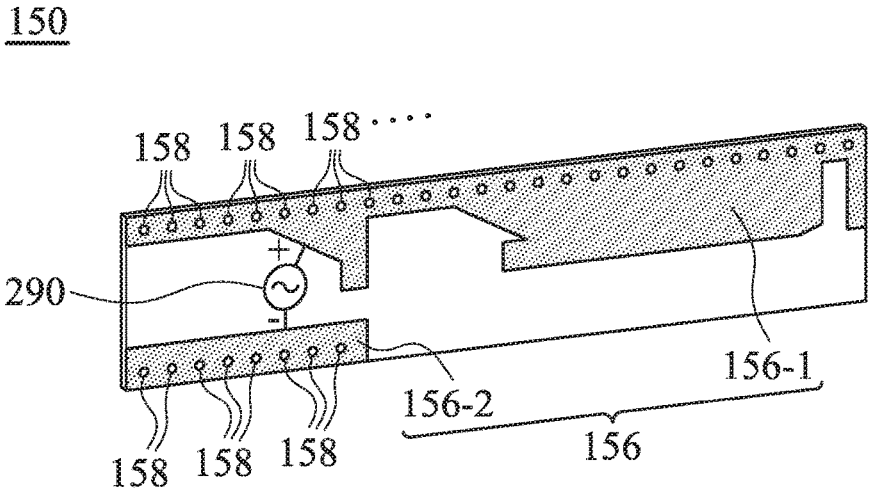
FIG. 4B is a bottom view of a second PCB according to an embodiment of the invention.

FIG. 4A is a top view of the second PCB 150 according to an embodiment of the invention. FIG. 4B is a bottom view of the second PCB 150 according to an embodiment of the invention. As shown in FIG. 4A, on the top surface of the second PCB 150, the third metal element 154 has a closed loop structure and surrounds a second nonconductive region 155. For example, the third metal element 154 may have a hollow rectangular shape, and its inner hollow portion is the second nonconductive region 155. The second nonconductive region 155 is aligned with the second slot 140 of the metal back cover 310. Specifically, the second slot 140 of the metal back cover 310 has a second vertical projection 145 on the second PCB 150, and the whole second vertical projection 145 is inside the second nonconductive region 155. That is, the area of the second slot 140 of the metal back cover 310 is smaller than or equal to the area of the second nonconductive region 155. As shown in FIG. 4B, on the bottom surface of the second PCB 150, the fourth metal element 156 includes a third portion 156-1 and a fourth portion 156-2. The third portion 156-1 and the fourth portion 156-2 are separate from each other and are both coupled through the second via elements 158 to the third metal element 154. The third portion 156-1 may have a relatively long irregular shape, and the fourth portion 156-2 may have a relatively short straight-line shape. A positive electrode of the second signal source 290 is coupled to the third portion 156-1, and a negative electrode of the second signal source 290 is coupled to the fourth portion 156-2.

In the embodiment of FIG. 3A and FIG. 3B, the mobile device 300 includes a first slot antenna and a second slot antenna, and they operate in the same frequency band. The first slot antenna may be used as a main antenna, and the second slot antenna may be used as an auxiliary antenna, so as to increase the antenna diversity gain of the mobile device 300. Such a design can further enhance the side radiation of the mobile device 300. For example, in the mobile device 300, the first slot antenna may have a strong radiation strength in the direction along −X axis of FIG. 3A, and the second slot antenna may have a strong radiation strength in the direction along +X axis of FIG. 3A.

The element sizes of the mobile device 300 may be as follows. The length L2 of the second slot 140 of the metal back cover 310 may be equal to 0.5 wavelength (λ/2) of a central operation frequency of the second slot antenna, or may be 60 mm. The spacing D3 between the second slot 140 of the metal back cover 310 and a third edge 313 of the metal back cover 310 may be from 40 mm to 50 mm. The spacing D4 between the second slot 140 of the metal back cover 310 and a second edge 312 of the metal back cover 310 may be longer than 10 mm. Furthermore, in order to prevent the first slot antenna and the second slot antenna from interfering with each other, the spacing D21 between the first slot antenna and the second slot antenna should be longer than 0.5 wavelength of their central operation frequency, or longer than 60 mm.

In some embodiments, the second signal source 290 is coupled through a second coaxial cable to the fourth metal element 156, so as to excite the second slot antenna. The length of the second coaxial cable may be correlated to the size of a display device of the mobile device 300. For example, if the size of the display device of the mobile device 300 is 17-inch, the length of the second coaxial cable should be shorter than 500 mm; if the size of the display device of the mobile device 300 is 15-inch, the length of the second coaxial cable should be shorter than 550 mm; and if the size of the display device of the mobile device 300 is 13-inch, the length of the second coaxial cable should be shorter than 600 mm. In other words, if the display device becomes larger, the upper limit of the length of the second coaxial cable will become lower, and conversely, if the display device becomes smaller, the upper limit of the length of the second coaxial cable will become higher. The above design helps to suppress transmission line loss and maintain good radiation efficiency of the second slot antenna.

Figure 5:
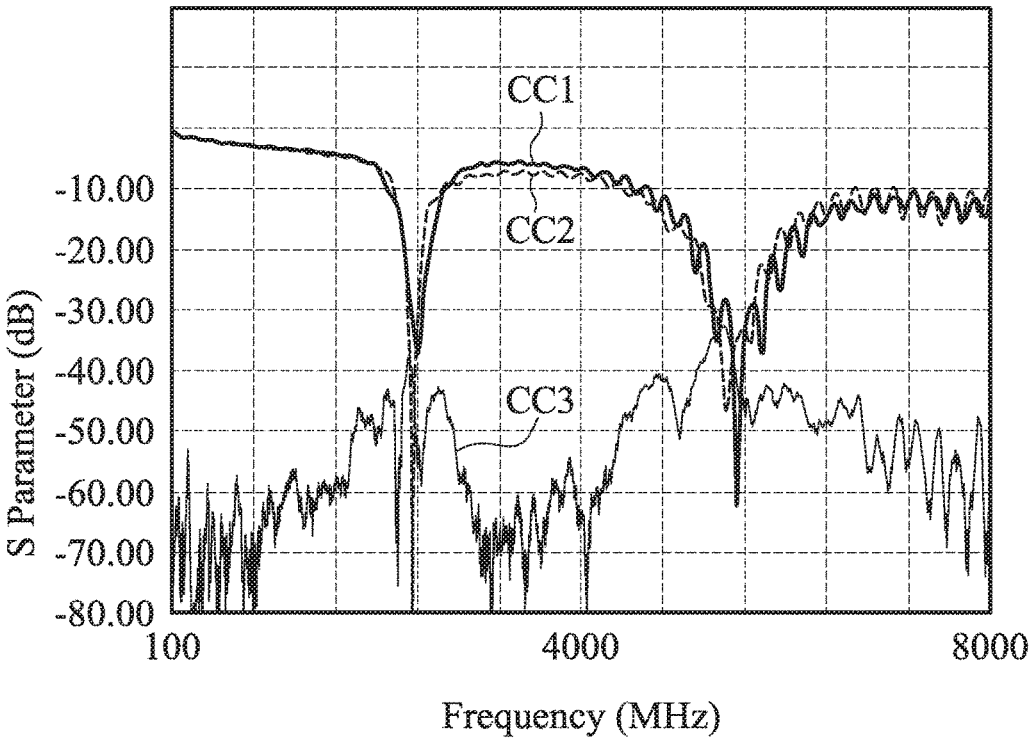
FIG. 5 is a diagram of S parameters of slot antennas of a mobile device according to an embodiment of the invention.

FIG. 5 is a diagram of S parameters of the slot antennas of the mobile device 300 according to an embodiment of the invention. The horizontal axis represents the operation frequency (MHz), and the vertical axis represents the S parameters (dB). In the embodiment of FIG. 5, the first slot antenna is set as a first port (Port 1), and the second slot antenna is set as a second port (Port 2). A first curve CC1 represents the S11 parameter of the first slot antenna. A second curve CC2 represents the S22 parameter of the second slot antenna. A third curve CC3 represents the S21 (or S12) parameter between the first slot antenna and the second slot antenna. As shown in FIG. 5, the first slot antenna and the second slot antenna can operate in the same operation frequency band, which is from about 2400 MHz to about 2500 MHz and further from about 5150 MHz to about 5850 MHz. Within the operation frequency band, the S21 parameter between the first slot antenna and the second slot antenna can be lower than −30 dB, which means that the first slot antenna and the second slot antenna of the invention have good isolation therebetween and they do not tend to interfere with each other.

The invention proposes a novel mobile device and a slot antenna therein. In comparison to the convention design, the invention has at least the advantages of: (1) reducing the area of antenna ground copper, (2) decreasing manufacturing time, (3) suppressing manufacturing errors, (4) enhancing the side radiation of the mobile device, (5) overcoming the shielding effect from the metal back cover, and (6) reducing manufacturing costs.

Note that the above element sizes, element shapes, and frequency ranges are not limitations of the invention. An antenna engineer can adjust these settings or values according to different requirements. It should be understood that the mobile device and slot antenna of the invention are not limited to the configurations of FIGS. 1-5. The invention may merely include any one or more features of any one or more embodiments of FIGS. 1-5. In other words, not all of the features shown in the figures should be implemented in the mobile device and slot antenna of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A mobile device, comprising:

a metal back cover, having a first slot; and a first PCB (Printed Circuit Board), comprising a first dielectric substrate, a first metal element, a second metal element, and a plurality of first via elements, wherein the first metal element is disposed on a top surface of the first dielectric substrate, the second metal element is disposed on a bottom surface of the first dielectric substrate, and the first via elements are formed in the first dielectric substrate and coupled between the first metal element and the second metal element;

wherein the first metal element is coupled to the metal back cover, such that a first slot antenna is formed by the first PCB and the first slot of the metal back cover;

wherein the first slot antenna is excited by a first signal source, and the first signal source is coupled to the second metal element;

wherein the first slot is a closed slot, and a length of the first slot is equal to 0.5 wavelength of a central operation frequency of the first slot antenna;

wherein the metal back cover further has a second slot;

wherein spacing between the first slot and the second slot is longer than 0.5 wavelength of the central operation frequency of the first slot antenna;

wherein the second metal element comprises a first portion and a second portion, the first portion and the second portion are separate from each other and are both coupled through the first via elements to the first metal element a positive electrode of the first signal source is coupled to the first portion, and a negative electrode of the first signal source is coupled to the second portion;

wherein the first portion has an irregular shape, and the second portion has a straight-line shape; wherein the first portion is longer than the second portion.

2. The mobile device as claimed in claim 1, wherein the first metal element has a closed loop structure and surrounds a first nonconductive region, and the first nonconductive region is aligned with the first slot of the metal back cover.

3. The mobile device as claimed in claim 2, wherein the first slot of the metal back cover has a first vertical projection on the first PCB, and the whole first vertical projection is inside the first nonconductive region.

4. The mobile device as claimed in claim 1, wherein the first metal element is affixed by conductive paste to a periphery of the first slot of the metal back cover.

5. The mobile device as claimed in claim 1, wherein the mobile device further comprises:

a second PCB, comprising a second dielectric substrate, a third metal element, a fourth metal element, and a plurality of second via elements, wherein the third metal element is disposed on a top surface of the second dielectric substrate, the fourth metal element is disposed on a bottom surface of the second dielectric substrate, and the second via elements are formed in the second dielectric substrate and coupled between the third metal element and the fourth metal element;

wherein the third metal element is coupled to the metal back cover, such that a second slot antenna is formed by the second PCB and the second slot of the metal back cover;

wherein the second slot antenna is excited by a second signal source, and the second signal source is coupled to the fourth metal element.

6. The mobile device as claimed in claim 5, wherein the third metal element has a closed loop structure and surrounds a second nonconductive region, and the second nonconductive region is aligned with the second slot of the metal back cover.

7. The mobile device as claimed in claim 6, wherein the second slot of the metal back cover has a second vertical projection on the second PCB, and the whole second vertical projection is inside the second nonconductive region.

8. The mobile device as claimed in claim 5, wherein the fourth metal element comprises a third portion and a fourth portion, the third portion and the fourth portion are separate from each other and are both coupled through the second via elements to the third metal element, a positive electrode of the second signal source is coupled to the third portion, and a negative electrode of the second signal source is coupled to the fourth portion.

9. The mobile device as claimed in claim 5, wherein the first slot antenna and the second slot antenna operate in a same operation frequency band from about 2400 MHz to about 2500 MHz and further from about 5150 MHz to about 5850 MHz.

* * * * *